US008336743B2

(12) United States Patent
Bellmore

(10) Patent No.: US 8,336,743 B2
(45) Date of Patent: Dec. 25, 2012

(54) TAP

(75) Inventor: David Bellmore, Aurora, IL (US)

(73) Assignee: Scholle Corporation, Irvine, CA (US)

( * ) Notice: Subject to any disclaimer, the term of this patent is extended or adjusted under 35 U.S.C. 154(b) by 678 days.

(21) Appl. No.: 12/460,126

(22) Filed: Jul. 14, 2009

(65) Prior Publication Data

US 2011/0011898 A1 Jan. 20, 2011

(51) Int. Cl.
*B67D 3/04* (2006.01)

(52) U.S. Cl. ..... 222/509; 222/559; 222/542

(58) Field of Classification Search ..... 222/105, 222/509, 542, 559, 554, 552, 563
See application file for complete search history.

(56) References Cited

U.S. PATENT DOCUMENTS

| | | | | | |
|---|---|---|---|---|---|
| 3,777,936 | A * | 12/1973 | Hazard | 222/48 |
| 4,619,377 | A * | 10/1986 | Roos | 222/83 |
| 5,261,567 | A * | 11/1993 | Krall | 222/153.14 |
| 6,119,905 | A * | 9/2000 | Cocchi et al. | 222/509 |
| 6,978,981 | B2 * | 12/2005 | Roos | 251/334 |
| 7,740,151 | B2 * | 6/2010 | Stone | 222/95 |
| 7,975,980 | B2 * | 7/2011 | Gao et al. | 251/48 |
| 7,997,461 | B2 * | 8/2011 | Lester et al. | 222/518 |
| 8,109,416 | B2 * | 2/2012 | Morand | 222/559 |
| 2005/0211726 | A1 * | 9/2005 | Pritchard | 222/105 |
| 2008/0237273 | A1 * | 10/2008 | Smith et al. | 222/509 |
| 2011/0006079 | A1 * | 1/2011 | Mckay et al. | 222/144.5 |

* cited by examiner

*Primary Examiner* — Kevin P Shaver
*Assistant Examiner* — Donnell Long
(74) *Attorney, Agent, or Firm* — The Watson I.P. Group, PLC; Jovan N. Jovanovic; Vladan M. Vasiljevic

(57) ABSTRACT

A tap for use in association with bag in box containers comprising a body, a plug member, an upper seal assembly and a lower seal assembly. The body includes a tap nozzle in the form of an elongated tube having an inner surface and an outer surface, a handle opening at a first end and a dispensing opening at the second end. A nozzle opening extends into the elongated tube between the first and second ends and is placeable in fluid communication with a bag of a bag in box container. The plug member is structurally configured to fit and slidably move within the elongated tube of the body such that the outer surface of the plug member faces the inner surface of the elongated tube. In the open orientation, the nozzle opening is in fluid communication with the dispensing opening. In the closed orientation, the nozzle opening is precluded from fluid communication with the dispensing opening. The upper seal assembly includes an upper seal surface region and an upper seal bead positioned between the nozzle opening and the handle opening of the body. The upper seal assembly maintains continuous sealing engagement between the closed orientation and the open orientation of the tap.

14 Claims, 5 Drawing Sheets

TAP

BACKGROUND OF THE DISCLOSURE

1. Field of the Disclosure

The disclosure relates in general to fluid delivery taps, and more particularly, to a fluid delivery tap which is configured for use in association with bag in box containers. While not specifically limited to use therewith, the tap has structural features which render it quite useful in association with bag in box containers.

2. Background Art

The use of taps for controlling the dispensing of flowable material from a flexible package, such as a bag are known. Such taps provide a means by which to dispense particular quantities of flowable material. Typically such taps, especially in the bag in box environment are formed from a polymer material. Due to the respective costs of such products, and the fact that they are a single use item, it is necessary to provide a tap that does not leak, that adequately controls dispensing, while minimizing cost.

A number of different taps have been commercially available. One particular segment of the taps has focused on taps that are actuated through rotation of a piston. Such taps are shown in each of U.S. Pat. No. 6,978,981 issued to Roos entitled "Taps for Controlling Liquid Flow" and U.S. Pat. No. 4,619,377 issued to Roos entitled "Tap", the entire disclosures of each of the patents is hereby incorporated by reference in their entirety.

Amongst other deficiencies, the foregoing taps, and especially the tap shown in the '981 patent fail to effectively maintain an upper seal (i.e., above the inlet opening) throughout the movement of the piston within the cylinder bore. Once the tap is opened, the upper seals disengage, and reliance is made upon the interference between the piston and the cylinder bore to preclude leaking.

A separate drawback to these taps, in addition, is that these taps have lower seals that retain residual fluid. Often after the tap is shut off, the residual fluid collects and drips from the bottom of the tap. When the tap is used with wine, in, for example, a refrigerator, the unsightly drip is often a source of frustration to the user.

It is an object of the present invention to provide a cost effective tap that is adapted for use in association with bag in box packaging.

It is another object of the present invention to provide a tap that is actuated through rotation wherein the upper seal above the inlet is maintained throughout the operational movement of the piston within the cylinder.

It is another object of the present invention to provide a tap that limits the formation of residual fluid, and in turn dripping after the tap is in a closed position.

It is another object of the invention to overcome the deficiencies of the prior art.

These objects as well as other objects of the present invention will become apparent in light of the present specification, claims, and drawings.

SUMMARY OF THE DISCLOSURE

The disclosure is directed to a tap for use in association with bag in box containers comprising a body, a plug member, an upper seal assembly and a lower seal assembly. The body includes tap nozzle in the form of an elongated tube having an inner surface and an outer surface, a handle opening at a first end and a dispensing opening at the second end thereof, and a nozzle opening into the elongated tube between the first and second ends. The nozzle opening is placeable in fluid communication with a bag of a bag in box container.

The plug member has a first end and a second end and an outer surface. The plug member is structurally configured to fit within the elongated tube of the body such that the outer surface of the plug member faces the inner surface of the elongated tube. The plug member is also structurally configured to be slidably movable within the elongated tube of the body between a closed orientation and an open orientation. In the open orientation, the nozzle opening is in fluid communication with the dispensing opening. In the closed orientation, the nozzle opening is precluded from fluid communication with the dispensing opening.

The upper seal assembly has an upper seal surface region positioned on one of the outer surface of the plug member or the inner surface of the elongated tube between the nozzle opening and the handle opening of the body, and, an upper seal bead positioned on the other of the outer surface of the plug member and the inner surface of the elongated tube between the nozzle opening and the handle opening of the body. The upper seal assembly maintains continuous sealing engagement between the closed orientation and the open orientation of the tap. The lower seal assembly is configured to seal the tap nozzle and the plug member between the nozzle opening and the dispensing opening.

In a preferred embodiment, the upper seal surface region is positioned on the inner surface of the elongated tube between the nozzle opening and the handle opening of the body. The upper seal bead is positioned on the plug member.

In one such embodiment, the interference between the upper seal surface region and the upper seal bead is between approximately 0.07 mm and 0.11 mm, on each side.

In another such embodiment, the upper seal surface region is inclined so that an interference between the upper seal surface region and the upper seal bead decreases between the closed position and the open position.

Preferably, the upper seal surface region is curved so that an interference between the upper seal surface region and the upper seal increases proximate the closed position and the open position and decreases between the two positions.

In another such embodiment, the upper seal bead is biased inwardly by the upper seal surface region.

In a preferred embodiment, the lower seal assembly further includes a lower seal surface region on one of the inner surface of the elongated tube between the nozzle opening and the dispensing opening or the outer surface of the plug member and a lower seal bead on the other of the inner surface of the elongated tube between the nozzle opening and the dispensing opening or the outer surface of the plug member.

In one such embodiment, the lower seal surface region is positioned on the inner surface of the elongated tube and the lower seal bead is positioned on the outer surface of the plug member.

In another such embodiment, the lower seal bead is biased inwardly by the lower seal surface region.

In another embodiment, the lower seal bead contacts the lower seal surface region prior to engagement of the second end of the plug member with the dispensing opening when the plug member is moving from an open position toward a closed position.

In one such preferred embodiment, the tap further includes a funnel region on the outer surface of the plug member between the lower seal bead and the second end of the plug member and a funnel region on the elongated tube between the lower seal surface region and the dispensing opening. The two funnel regions are spaced apart when the tap is in the closed position while the second end of the plug member engages the dispensing opening and the lower seal bead sealingly engages the lower seal surface region in the closed position.

In one such embodiment, the lower seal surface region terminates below the nozzle opening, to in turn, disengage the lower seal bead from the lower seal surface region prior to the lower seal bead traversing the nozzle outlet.

In a preferred embodiment, the body comprises a material having a first flexural modulus and the plug member comprises a material having a second flexural modulus. The flexural modulus of the elongated tube relative to the plug member is preferably greater than approximately 1.2.

In one such embodiment, the body comprises a PET material and the plug member comprises an HDPE material.

In another aspect of the disclosure, the tap includes a body, a plug member, an upper seal assembly and a lower seal assembly. The body includes a tap nozzle in the form of an elongated tube having an inner surface and an outer surface, a handle opening at a first end and a dispensing opening at the second end thereof, and a nozzle opening into the elongated tube between the first and second ends. The nozzle opening is placeable in fluid communication with a bag of a bag in box container.

The plug member has a first end and a second end and an outer surface. The plug member is structurally configured to fit within the elongated tube of the body such that the outer surface of the plug member faces the inner surface of the elongated tube. The plug member is also structurally configured to be slidably movable within the elongated tube of the body between a closed orientation and an open orientation. In the open orientation, the nozzle opening is in fluid communication with the dispensing opening. In the closed orientation, the nozzle opening is precluded from fluid communication with the dispensing opening.

An upper seal assembly is configured to seal the tap nozzle and the plug member between the nozzle opening and the handle opening. A lower seal assembly is configured to seal the tap nozzle and the plug member between the nozzle opening and the dispensing opening. The lower seal assembly includes a lower seal surface region on one of the inner surface of the elongated tube between the nozzle opening and the dispensing opening or the outer surface of the plug member and a lower seal bead on the other of the inner surface of the elongated tube between the nozzle opening and the dispensing opening or the outer surface of the plug member. The lower seal bead contacts the lower seal surface region prior to engagement of the second end of the plug member with the dispensing opening when the plug member is moving from an open position toward a closed position.

In one embodiment, the lower seal surface region is positioned on the inner surface of the elongated tube and the lower seal bead is positioned on the outer surface of the plug member.

In one such embodiment, the lower seal bead is biased inwardly by the lower seal surface region.

In another such embodiment, the tap includes a funnel region on the outer surface of the plug member between the lower seal bead and the second end of the plug member and a funnel region on the elongated tube between the lower seal surface region and the dispensing opening. The two funnel regions are spaced apart when the tap is in the closed position while the second end of the plug member engages the dispensing opening and the lower seal bead sealingly engages the lower seal surface region in the closed position.

Preferably, the lower seal surface region terminates below the nozzle opening, to in turn, disengage lower seal bead from the lower seal surface region prior to the lower seal bead traversing the nozzle outlet.

BRIEF DESCRIPTION OF THE DRAWINGS

The disclosure will now be described with reference to the drawings wherein.

DETAILED DESCRIPTION OF THE DISCLOSURE

Figure 1:
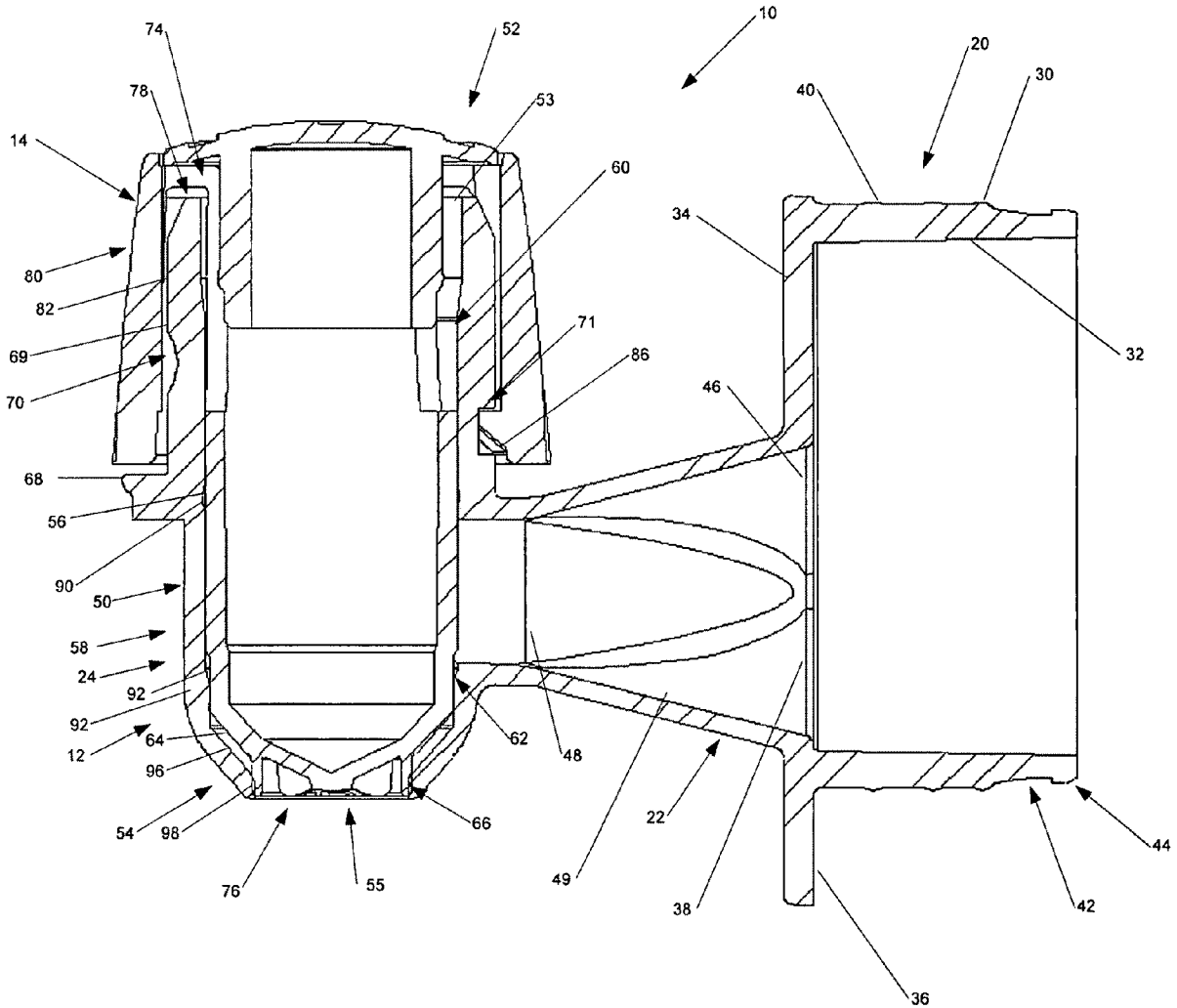
FIG. 1 of the drawings is a cross-sectional view of an embodiment of the tap of the present invention.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the tap of the present invention is shown generally at 10. Tap 10 is configured for use in association with bag in box containers. Such containers are typically utilized for the storage and dispensing of a number of flowable materials, such as, for example, wine products and the like. Such taps must be inexpensive to produce, but must also be able to withstand the rigors of worldwide shipping by air, rail, ship and truck. Additionally, the tap must be able to work reliably to dispense fluid without inadvertent leaking and seeping of the fluid.

The invention is not limited to use in association with wine products, and it will be understood that wine products are merely exemplary. Typically, bag in box containers include a bag having a spout. The bag is typically between 1 liter and 5 liters (although other sizes are likewise contemplated, without limitation). The tap is coupled to the spout of such a bag, and the bag is inserted into the outer box. Generally, the outer box includes an opening through which the tap and spout can extend (and to which they can be coupled).

With further reference to FIG. 1, the tap includes body 12 and plug member 14. The body 12 includes tap barrel 20, tap neck 22 and tap nozzle 24. The body 12 is typically an integrated molded polymer member. Preferably, the tap body comprises a PET material. Of course, other materials are contemplated for use, such as HDPE, for example. Advantageously, PET exhibits a substantially lower oxygen transmission rate than HDPE (i.e., up to a fifty fold reduction in oxygen transmission). For certain fluids, such as wine, any reduction in oxygen transmission rates is highly desirable, as oxygen negatively impacts the taste of wine.

With respect to the body, the tap barrel 20 includes outer surface 30, inner surface 32 and front wall 34. The outer surface 30 interfaces with the spout of a bag. Generally the spout of the bag includes an inner bore and an outer surface with a plurality of flanges. Generally a large flange on the outside surface of the spout is sealed to an opening of a bag, thereby providing fluid communication with the contents housed within the bag. The outer surface of the tap barrel includes a plurality of seal beads which interface with the inner bore of the spout to provide a fluid-tight seal. Additionally, a detent 42 and flange 44 are provided. The tap barrel is sized so that when fully inserted into the inner bore of the spout, the flange 44 interfaces with an opposite feature, thereby locking the tap barrel to the spout, and precluding inadvertent disengagement. The detent 42 serves, in part, to define the dimensions of the flange 44.

The front wall 34 of the tap barrel 20 includes front flange 36 and opening 38. The front flange 36 can be used as a location device for automated tap installation equipment and in automated filling equipment (i.e., Form seal fill (FSF) equipment, and the like). In the embodiment shown, the front flange includes a flattened region above the tap neck. Such a configuration allows for the positioning of the tap in a desired orientation within forming and filling equipment. Additionally, the tap nozzle is sized so that it is smaller than the diameter of the front flange, such that the diameter of the front flange is the largest dimension of any member of the tap. The front flange further includes opening 38 to which tap neck 22 is interfaced.

More specifically, tap neck 22 includes barrel opening 46, nozzle opening 48 and inner wall 49. The tap neck provides fluid communication between the opening 38 of the tap barrel and the tap nozzle. The tap neck further separates the tap nozzle from the box housing the bag when in use. As a result, the user can manipulate and operate the tap without having the box in the way of operation. In the embodiment shown, the tap neck tapers from a larger cross-sectional configuration at barrel opening 46 to a smaller diameter at nozzle opening 48. In the particular embodiment, the taper is substantially uniform. Of course, other configurations of the tap neck are likewise contemplated.

The tap nozzle 24 is shown in FIG. 1 as comprising elongated tube 50. The elongated tube 50 includes first end 52, second end 54, inner surface 56 and outer surface 58. An opening is positioned at each of the first end 52 and the second end 54. In particular, handle opening 53 is positioned at the first end 52 and dispensing opening 55 is positioned at the second end 54. The nozzle opening 48 extends into the elongated tube 50 between the first end 52 and the second end 54, thereby providing fluid communication between the elongated tube and, eventually, the inner contents of the bag to which the tap is coupled. The elongated tube, in operation extends substantially vertically, so that the dispensing of fluid through the dispensing opening of the tap nozzle occurs with the assistance of gravity.

The inner surface 56 of the elongated tube 50 includes upper seal surface region 60, lower seal surface region 62, funnel region 64 and lower opening seal 66. Each of the seal surfaces, as will be explained, cooperate with the respective seal bead on the plug member to provide a seal against the passage of fluid thereacross. Dimensionally, in the preferred embodiment, the elongated tube has a substantially cylindrical configuration. The upper seal surface region 60 has a first diameter, the lower seal surface region 62 has a smaller diameter than the upper seal surface region. The funnel region 64 tapers at a decreasing diameter, and finally, the lower opening seal 66 is of lesser diameter than the lower seal surface region. Thus, the three seals comprise successively smaller diameters.

The outer surface 58 includes cap area flange 68 and cam region 69. The cap area flange 68 separates the tap nozzle into an upper portion (having the user articulatable actuator), and a lower portion which comprises the dispenser. The actuator moves vertically in the area above the cap area flange 68. The cam region 69 resides on the outer surface 58 of the tap nozzle 24 above the cap area flange 68.

The cam region 69 includes first cam profile 70 and second cam profile 71. The two cam profiles are positioned on opposing sides of the outer surface. In certain embodiments, the two cam profiles can be replaced with a single cam profile or with more than two cam profiles. The cam profiles are, in the present embodiment, substantially identical and follow a generally downward inclination in a clockwise direction. A tab can be positioned near the upper and lower ends of the cam profile to provide a locking feature. Specifically, a user will require additional force to extend over and beyond the tab, which can then signal that the end of travel in each direction has been reached. Additionally, such a tab provides tactile feedback that the tap has been definitively moved from a closed position toward an open position.

Figure 2:
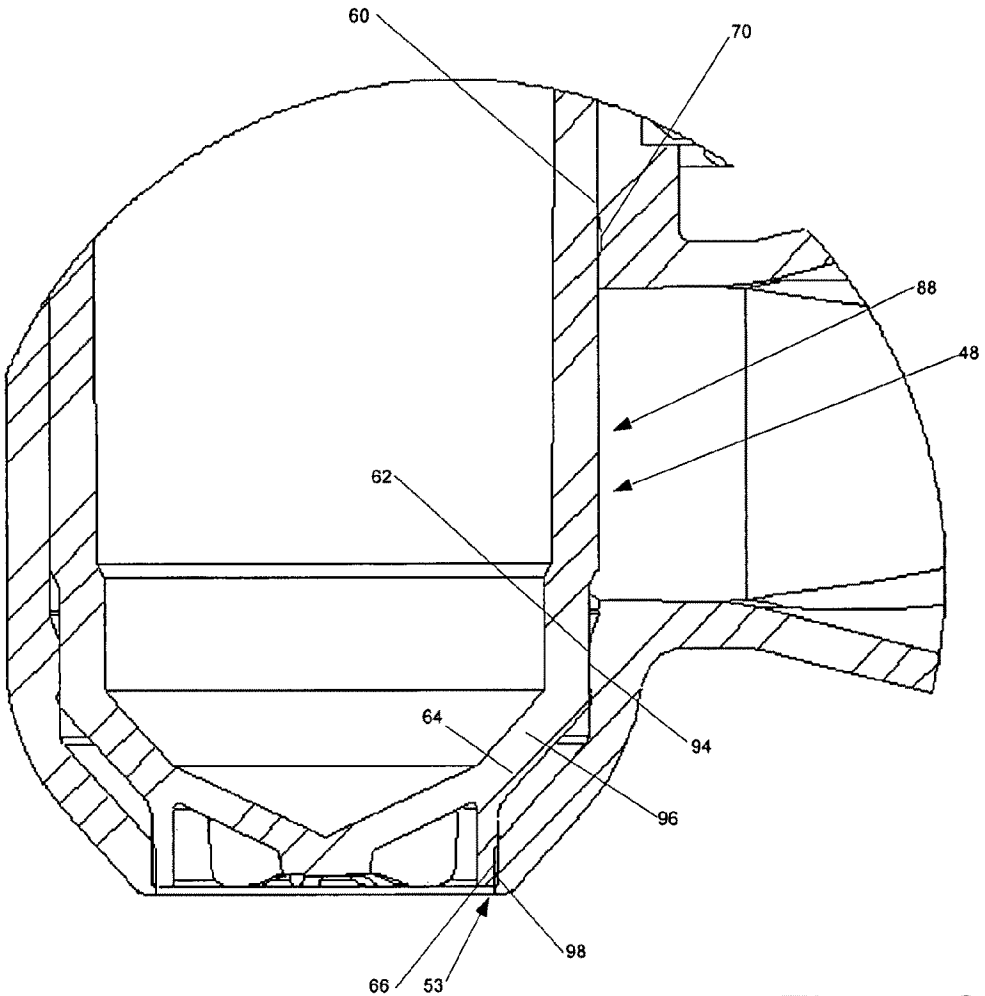
FIG. 2 of the drawings is a partial cross-sectional view of the embodiment of the tap of the present invention.

The plug member 14 is shown in FIG. 1 as comprising first end 74, second end 76, upper flange 78, outer skirt 80 and outer surface 88 (FIG. 2). The plug member is structurally configured to fit within the elongated tube of the body such that the outer surface of the plug member faces the inner surface of the elongated tube, the plug member also structurally configured to be slidably movable within the elongated tube of the body. The fit between the plug member and the elongated tube of the body is on the order of approximately 0.02 mm on either side. Of course, this is merely exemplary, and in certain embodiments, there may be a lesser or greater clearance between the plug member and the elongated tube.

The plug member is preferably made from a material that is different than the material from which the elongated tube is made. Such a configuration further facilitates the sealing engagement of the sealing structures on the respective surfaces. It has been found that a ratio of flexural modulus of the elongated tube relative to the plug member is preferably greater than approximately 1.2. In the preferred embodiment, the plug member comprises a HDPE material, whereas the elongated tube comprises a PET material. Generally, HDPE has a flexural modulus that ranges between approximately 140,000 psi to 240,000 psi. One particular contemplated HDPE material comprises a 170,000 psi flexural modulus. The PET flexural modulus has a range between 350,000 PSI and 450,000 PSI. For embodiments wherein the elongated tube comprises a PET material and the plug member comprises an HDPE material, the ratio of the flexural modulus ranges between approximately 1.46 and 3.21. Of course, other material combinations are likewise contemplated, and, it is preferred that the ratio is greater than approximately 1.2.

The first end 74 of the plug member substantially corresponds to the first end of elongated tube 50 of tap nozzle 24 and the second end 76 of the plug member substantially corresponds to the second end of the elongated tube 50 of tap nozzle 24 when in a closed configuration. A rosette can be positioned on the bottom of the plug member at the second end to further aid in the suppression of drips. Additionally, wherein the plug member is hollow and includes an open first end, a cap may be provided to cover the open first end.

The plug member moves within the inside of the elongated tube, and the outer skirt traverses the cam region 69 of the tap nozzle. The outer skirt is joined to the first end of the plug member 14 by way of upper flange 78. The outside of the outer skirt may include a plurality of alternating ridges and valleys to provide additional grip to a user that is manipulating the outer skirt. The outer skirt includes an inner surface 82. A plurality of opposing followers, one of which is shown as follower 86, extend outwardly from the inner surface of the outer skirt toward the outer surface of the plug member 14. These two followers interface with the cam profiles 70, 71, respectively, so that as the plug member is rotated relative to the tap nozzle, the followers interface with the cam profiles to translate the plug member in an upward and downward direction. Of course, it is contemplated that the follower can be placed on the outer surface 58 of the elongated tube 50 and the cam surfaces can be embedded within the inner surface 82 of the outer skirt 80.

The outer surface 88 of the plug member 14 includes upper seal bead 90, lower taper 92, lower seal bead 94, funnel region 96 and drip seal bead 98. The upper seal bead 90 comprises a semi-circular bead that extends about the circumference of the outer seal. The lower seal bead 94 and the drip seal bead 98 have similar configurations (in certain embodiments the drip seal bead may comprise a barrel in barrel seal, wherein the bead may comprise the entire dimensional area). The upper seal bead 90, when the plug member 14 is installed within the tap nozzle, interfaces with the upper seal surface region 60 to provide a fluid tight seal, and to define an upper seal assembly. The upper seal bead 90 has a diameter that is slightly larger than the diameter of the upper seal region 60 so that the upper seal surface region 60 inwardly biases and directs the upper seal bead 90 so as to provide a substantially leak proof barrier. For example, it is contemplated that the interference between the upper seal bead and the upper seal region is approximately between 0.07 mm and 0.11 mm, on each side, most preferably. Of course, the particular interference can be varied depending on the resistance that is desired to rotation of the plug member, the materials selected, the type of fluid dispensed, among other considerations. In the embodiment shown, the upper seal bead 90 remains in contact with the upper seal surface region 60 throughout the operative range of the plug member relative to the tap nozzle.

In the embodiment shown, the upper seal surface region 60 has a substantially uniform diameter so that the inward biasing force exerted upon the upper seal region 60 remains substantially uniform throughout the operative range. In other embodiments, the diameter of the upper seal surface region 60 can be varied throughout the operative range. For example, the diameter of the upper seal region 60 can be uniformly increasing as the tap is opened. In such an embodiment, the user will feel greater resistance to movement as the tap gets closer to the closed orientation, and less resistance to movement as the tap gets closer to the open orientation. In another embodiment, the upper seal region 60 may include areas of smaller diameter at either end of the operative range so that an increase in resistance is realized when the tap reaches the fully closed or the fully open orientation. In summary, along the length of the operative range of the upper seal system, the interference can be varied between certain limits, to alter the resistance to movement.

Figure 4:
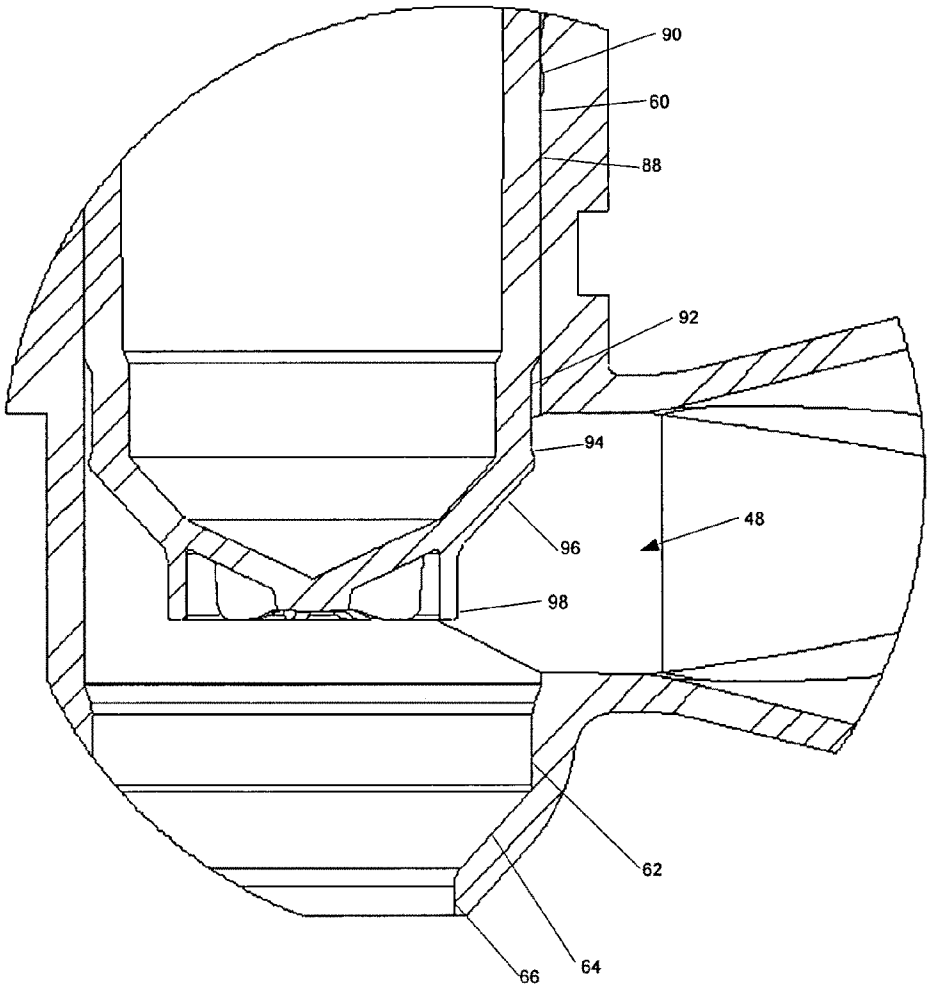
FIG. 4 of the drawings is a partial cross-sectional view of the embodiment of the tap of the present invention.
Figure 5A:
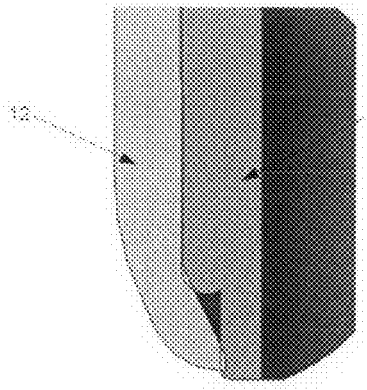
FIGS. 5*a* through 5*e* of the drawings comprise a partial cross-sectional view of a number of different lower seals which can be cooperatively coupled in a tap with the top seal of the embodiment of FIG. 1.
Figure 5B:
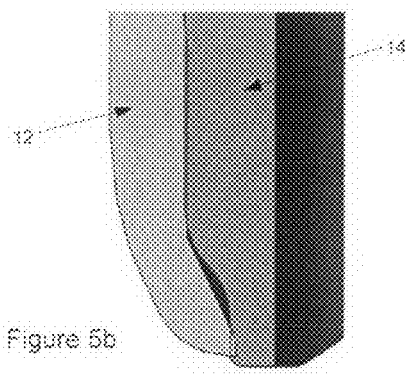
Figure 5C:
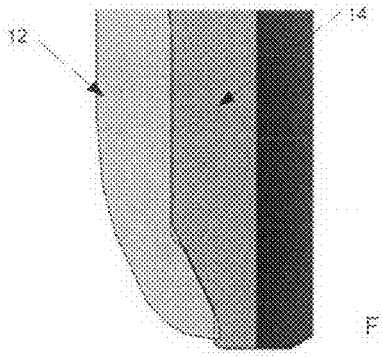
Figure 5D:
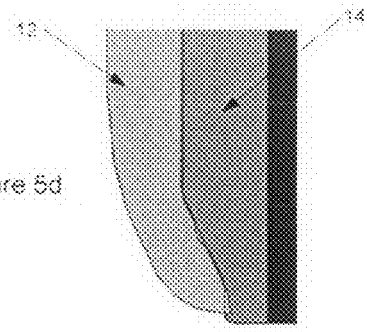
Figure 5E:
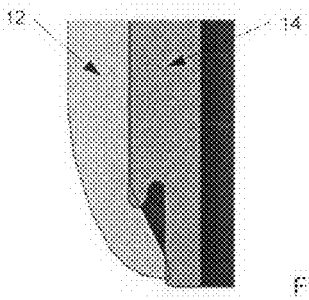

With additional reference to FIGS. 2 and 4, the lower seal bead 94 is configured to interface with the lower seal surface region 62. As with the upper seal, the lower seal bead 94 has a larger diameter than the lower seal surface region 62 such that when abutting, the lower seal surface region 62 applies a biasing force against the lower seal bead 94 to provide a fluid tight configuration, and thereby defining a lower seal assembly. As with other seals, it is contemplated that the interference between the lower seal bead and the lower seal region is approximately between 0.07 mm and 0.11 mm, most preferably (without limitation). The lower seal surface 62 has a diameter that is smaller than the upper seal region 60, and the lower seal surface 62 terminates short of the operation range of the plug member relative to the tap nozzle. As such, once the tap is opened a certain amount, the lower seal bead 94 extends beyond the lower seal surface 62 and is separated from the inner surface 56 of the elongated tube 50 of the tap nozzle 24.

In the embodiment shown, the lower seal surface 62 terminates below the nozzle opening 48. As will be explained in detail below with respect to the operation, as the user rotates and translates the plug member from a closed position to the open position, the lower seal bead 94 is separated from the inner surface of the tap nozzle prior to traversing beyond the nozzle opening 48, thereby improving the control of the flow when the flow of fluid is initiated and when it is closed, and allows for an improved ramp up and ramp down to the flow of fluid and limits spiking of fluid flow.

The drip seal bead 98 interfaces with the pour opening 66. As with the other seals, the drip seal bead 98 has a diameter that is larger than the pour opening 66. In turn, the pour opening directs the drip seal bead 98 in an inward direction, to, in turn, provide a substantially fluid tight seal, and thereby define a bead seal assembly. As with the other seals, the interference between the seal components is approximately between 0.07 mm and 0.11 mm, most preferably (without limitation). The drip seal bead 98 is positioned in close proximity to the end of the second end 76 so that the interface can be as close to the pour opening as possible, to, in turn, limit any residual dripping once the lower seal bead 94 interfaces with the lower seal surface region 62. In certain embodiments, the drip seal bead can be eliminated, instead relying on the sealing properties of the lower seal bead against the lower seal surface region. In such a configuration, the outer surface of the plug member and the inner surface 56 of the tap nozzle proximate the second end interfere with each other, but no substantial deflection or substantially fluid tight sealing takes place.

Figure 3:
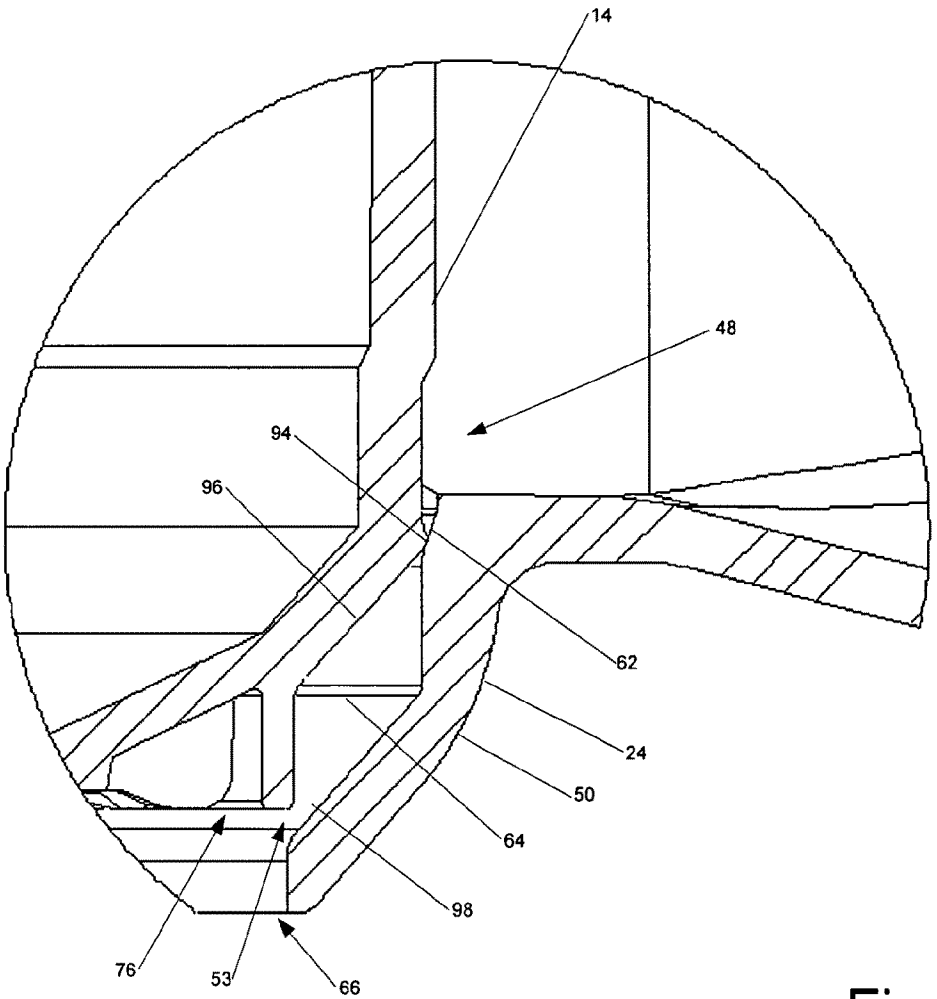
FIG. 3 of the drawings is a partial cross-sectional view of the embodiment of the tap of the present invention.

Preferably, in the closed position, the funnel region 64 of the tap nozzle 24 and the funnel region 96 of the plug member remain separated when the tap is in the fully closed orientation. Of course, in other embodiments, these surfaces may be in contact so as to provide additional sealing surfaces. With additional reference to FIG. 3, it will be understood that in the closing sequence, the lower seal bead 94 of the plug member sealingly engages the lower seal surface region 62 prior to the engagement of the drip seal bead 98 with the lower opening 66. This allows for any residual fluid that is trapped below the lower seal bead 94 to flow out of the tap prior to engagement of the drip seal bead 98. Such a configuration greatly decreases the undesirable dripping as the tap is closed and residual drips after dispensing is completed, and substantially diminishes the possibility of what is known in the wine dispensing industry as spitting.

In other embodiments, the lower seal can be altered in configuration, while retaining the disclosed upper seal configuration. In each such embodiment, shown in FIGS. 5*a* through 5*e*, the elongated tube lower seal surface region and pour region (where incorporated) direct the respective one of the lower seal bead and the drip seal bead in an inward direction. In still other embodiments, a thin walled portion proximate one or both of the beads can facilitate the inward movement of the respective valve seat. In other embodiments, the valve seat may comprise a dependent skirt which can be flexed inwardly by the cylindrical tube assembly. In still other embodiments, while retaining the upper seal disclosed herein, it will be understood that the lower seals can be replaced with a lower seal such as is disclosed in either one of U.S. Pat. No. 6,978,981 issued to Roos entitled "Taps for Controlling Liquid Flow" and U.S. Pat. No. 4,619,377 issued to Roos entitled "Tap", the entire disclosures of each of the patents is hereby incorporated by reference in their entirety.

Other modifications within the scope of the invention are likewise contemplated. For example, and not to be deemed limiting, the orientation of the seal surface regions can be swapped with the orientation of the seal beads for each of the upper, lower and pour seal assemblies, so that the beads are located on the inner surface of the elongated tube and the seal surfaces are located on the outer surface of the plug member.

The operation of the tap will be described with respect to a wine bag in box embodiment, with the understanding that the tap is not limited to such an environment or to such a fluid. The environment selected is a significant environment where ease of operation, cost and function are highly significant. In such an environment, a bag is selected and filled with the desired fluid. The tap is coupled to the spout of such a bag. As explained, above, to couple the tap to the spout, the tap is inserted into the inner bore of a spout until the flange 44 extends beyond the inner bore and interfaces with the corresponding structure on the inner surface of the spout and is captured thereby. The tap is then locked in position and substantial force is required to disconnect the tap from the spout. The remaining seal beads 40 on the outer surface 30 sealingly interface with the inner bore to, in turn, provide a fluid tight configuration.

The filled bag and tap are inserted into a box. Typically, such a box includes a frangible portion which can be removed to define an opening in the box. The tap can be extended through this opening and one of the spout and the tap can be coupled to the box at the opening.

When the user is ready to dispense the fluid, the user grasps the outer skirt 80 and rotates the outer skirt in a first direction (conventionally, a counter clockwise direction). Rotation of the outer skirt begins a number of simultaneous or successive events. In particular, the followers are guided by the cam surfaces to translate the plug member relative to the tap nozzle in an upward direction. As the plug member moves in an upward direction, the drip seal bead 98 separates from the pour opening. At the same time, the lower seal bead 94 sealingly translates against the lower seal surface region 62, and, the upper seal bead 90 translates against the upper seal surface region 60. Upon continued rotation, the lower seal bead 94 separates from the lower seal surface region 62. Due to the configuration of the nozzle opening and the lower seal surface region the nozzle opening 48 is placed in fluid communication with pour opening 66 and fluid begins to flow out of the tap.

Continued rotation of the skirt in the first direction further moves the plug member upwardly exposing successively greater portions of the nozzle opening. This continues until the second end of the cam surfaces is reached and the cam precludes further rotative movement of the plug member. Throughout the range of movement, the upper seal bead 90 remains sealingly engaged with the upper seal surface region 60.

When the user wants to stop flow of the fluid from within the container, the user rotates the outer skirt in a second direction (conventionally, a clockwise direction). As the outer skirt is rotated, the plug member is directed in a downward direction. Through continued movement, the lower seal bead 94 proceeds beyond the nozzle opening gradually reducing flow through the pour opening. Eventually, continued rotation directs the lower seal bead 94 into contact with the lower seal surface region 62 sealing the nozzle opening 48 from the pour opening.

While the flow of fluid from the nozzle opening has stopped, residual fluid remains between the lower seal bead 94 and the pour opening. Advantageously, even though the lower seal bead 94 has sealingly engaged the lower seal surface region 62, the funnel regions 64, 96 remain separated as does the drip seal bead 98 and the pour opening 66. Thus, the residual fluid is permitted to exit the tap. Continued rotation of the outer skirt further translates the plug member until the drip seal bead 98 engages the pour opening 66. During this movement, the funnel regions (which together effectively define a residual volume), get closer to each other successively reducing the residual volume within the tap below the lower seal bead 94 (which further expels any residual fluid). Thus, inadvertent drips can be virtually eliminated.

Eventually, the followers reach the first end of the cam surfaces, and the cam surfaces provide a barrier against further movement of the plug member relative to the tap nozzle. In the fully closed position, it is advantageous that the top flange remain separated from the first end of the tap nozzle and that the bottom of the skirt be separated from the cap area flange. This permits full travel of the followers and insures that the cam and follower configuration fully controls the movement of the plug member relative to the tap nozzle.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A tap for use in association with bag in box containers comprising:

a body having a tap nozzle in the form of an elongated tube having an inner surface and an outer surface, a handle opening at a first end and a dispensing opening at the second end thereof, and a nozzle opening into the elongated tube between the first and second ends, the nozzle opening being placeable in fluid communication with a bag of a bag in box container;

a plug member having a first end and a second end and an outer surface, the plug member structurally configured to fit within the elongated tube of the body such that the outer surface of the plug member faces the inner surface of the elongated tube, the plug member also structurally configured to be slidably movable within the elongated tube of the body between a closed orientation and an open orientation, wherein in the open orientation, the nozzle opening is in fluid communication with the dispensing opening and wherein in the closed orientation the nozzle opening is precluded from fluid communication with the dispensing opening;

an upper seal assembly comprising an upper seal surface region integrally molded on the inner surface of the elongated tube between the nozzle opening and the handle opening of the body, and, a upper seal bead integrally molded on the outer surface of the plug, wherein the upper seal assembly maintains continuous sealing engagement between the closed orientation and the open orientation of the tap; and an integrally molded lower seal assembly sealing the tap nozzle and the plug member between the nozzle opening and the dispensing opening and wherein the upper seal surface region includes an upper end and a lower end, the upper seal surface region being curved between the upper end and the lower end, so as to define a passage that is relatively narrower at the upper end and the lower end and relatively wider between the upper end and the lower end.

2. The tap of claim 1 wherein the interference between the upper seal surface region and the upper seal bead is between approximately 0.07 mm and 0.11 mm, on each side.

3. The tap of claim 1 wherein the upper seal surface region includes an upper end and a lower end, the upper seal surface region inclined so as to define a passage that narrows between the upper end and the lower end.

4. The tap of claim 1 wherein the upper seal bead is biased inwardly by the upper seal surface region.

5. The tap of claim 1 wherein the body comprises a material having a first flexural modulus and the plug member comprises a material having a second flexural modulus, wherein the flexural modulus of the elongated tube relative to the plug member is preferably greater than approximately 1.2.

6. The tap of claim 5 wherein the body comprises a PET material and the plug member comprises an HDPE material.

7. A tap for use in association with bag in box containers comprising:

a body having a tap nozzle in the form of an elongated tube having an inner surface and an outer surface, a handle opening at a first end and a dispensing opening at the second end thereof, and a nozzle opening into the elongated tube between the first and second ends, the nozzle opening being placeable in fluid communication with a bag of a bag in box container;

a plug member having a first end and a second end and an outer surface, the plug member structurally configured to fit within the elongated tube of the body such that the outer surface of the plug member faces the inner surface of the elongated tube, the plug member also structurally configured to be slidably movable within the elongated tube of the body between a closed orientation and an open orientation, wherein in the open orientation, the nozzle opening is in fluid communication with the dispensing opening and wherein in the closed orientation the nozzle opening is precluded from fluid communication with the dispensing opening;

an upper seal assembly comprising an upper seal surface region integrally molded on one of the outer surface of the plug member or on the inner surface of the elongated tube between the nozzle opening and the handle opening of the body, and, a upper seal bead integrally molded on the other of the outer surface of the plug member opening of the body, wherein the upper seal assembly maintains continuous sealing engagement between the closed orientation and the open orientation of the tap;

an integrally molded lower seal assembly sealing the tap nozzle and the plug member between the nozzle opening and the dispensing opening;

a lower seal surface region integrally molded on the inner surface of the elongated tube between the nozzle opening and the dispensing opening and a lower seal bead integrally molded on the outer surface of the plug member; and a drip seal bead positioned at the second end of the plug member wherein the lower seal bead contacts the lower seal surface region prior to engagement of the drip seal bead with the dispensing opening when the plug member is moving from an open position toward a closed position.

8. The tap of claim 7 wherein the lower seal bead is biased inwardly by the lower seal surface region.

9. The tap of claim 7 further comprising a funnel region on the outer surface of the plug member between the lower seal bead and the drip seal bead and a funnel region on the elongated tube between the lower seal surface region and the dispensing opening, the two funnel regions being spaced apart so as to define a cavity therebetween when the tap is in the closed position with the drip seal bead sealingly engaging the dispensing opening and the lower seal bead sealingly engaging the lower seal surface region in the closed position, to, in turn, facilitate the retention of a quantity of fluid within the cavity defined by the two funnel regions.

10. The tap of claim 7 wherein the lower seal surface region terminates below the nozzle opening, to in turn, disengage the lower seal bead from the lower seal surface region prior to the lower seal bead traversing the nozzle opening.

11. A tap for use in association with bag in box containers comprising:

a body having a tap nozzle in the form of an elongated tube having an inner surface and an outer surface, a handle opening at a first end and a dispensing opening at the second end thereof, and a nozzle opening into the elongated tube between the first and second ends, the nozzle opening being placeable in fluid communication with a bag of a bag in box container;

a plug member having a first end and a second end and an outer surface, the plug member structurally configured to fit within the elongated tube of the body such that the outer surface of the plug member faces the inner surface of the elongated tube, the plug member also structurally configured to be slidably movable within the elongated tube of the body between a closed orientation and an open orientation, wherein in the open orientation, the nozzle opening is in fluid communication with the dispensing opening and wherein in the closed orientation the nozzle opening is precluded from fluid communication with the dispensing opening;

an upper seal assembly sealing the tap nozzle and the plug member between the nozzle opening and the handle opening, with the upper seal integrally molded with each of the body and the plug member;

a lower seal assembly sealing the tap nozzle and the plug member between the nozzle opening and the dispensing opening, the lower seal assembly including a lower seal surface region integrally molded on the inner surface of the elongated tube between the nozzle opening and the dispensing opening and a lower seal bead integrally molded on the outer surface of the plug member, wherein the lower seal bead contacts the lower seal surface region prior to engagement of the second end of the plug member with the dispensing opening when the plug member is moving from an open position toward a closed position; and a drip seal bead positioned at the second end of the plug member and a funnel region on the outer surface of the plug member between the lower seal bead and the drip seal bead and a funnel region on the elongated tube between the lower seal surface region and the dispensing opening, the two funnel regions being spaced apart so as to define a cavity therebetween when the tap is in the closed position with the drip seal bead sealingly engaging the dispensing opening and the lower seal bead sealingly engaging the lower seal surface region in the closed position, to, in turn, facilitate the retention of a quantity of fluid within the cavity defined by the funnel regions.

12. The tap of claim 11 wherein the lower seal bead is biased inwardly by the lower seal surface region.

13. The tap of claim 11 wherein the lower seal surface region terminates below the nozzle opening, to in turn, disengage the lower seal bead from the lower seal surface region prior to the lower seal bead traversing the nozzle opening.

14. The tap of claim 11 wherein the body comprises a material having a first flexural modulus and the plug member comprises a material having a second flexural modulus, wherein the flexural modulus of the elongated tube relative to the plug member is preferably greater than approximately 1.2.

* * * * *